United States Patent [19]

Tsukamoto et al.

[11] Patent Number: 4,722,211

[45] Date of Patent: Feb. 2, 1988

[54] METHOD OF FORMING HOLLOW PARTS

[75] Inventors: Hidehiko Tsukamoto; Yoshiharu Taura; Hiroshi Shiota; Masanori Masumoto; Kotaro Yagishita, all of Hiroshima, Japan

[73] Assignee: Mitsubishi Jukogyo Kabushiki Kaisha, Tokyo, Japan

[21] Appl. No.: 319,019

[22] Filed: Nov. 9, 1981

[51] Int. Cl.[4] ..... B21H 1/18

[52] U.S. Cl. ..... 72/70; 72/110

[58] Field of Search ..... 72/70, 71, 72, 84, 107, 72/110

[56] References Cited

U.S. PATENT DOCUMENTS

| | | | |
|---|---|---|---|
| 2,060,767 | 11/1936 | Assel | 72/100 |
| 2,273,931 | 2/1942 | Byrnes | 72/84 |
| 2,679,089 | 5/1954 | Opitz et al. | 29/159.2 |
| 3,461,701 | 8/1969 | Marcovitch | 72/84 |
| 3,717,017 | 2/1973 | Vukovich | 72/68 |

FOREIGN PATENT DOCUMENTS

| | | | |
|---|---|---|---|
| 2538701 | 4/1976 | Fed. Rep. of Germany | 72/107 |

*Primary Examiner*—Lowell A. Larson

*Attorney, Agent, or Firm*—Michael F. Petock

[57] ABSTRACT

A method of roll forming hollow parts comprises introducing a workpiece into the space between a plurality of rolls rotatably arranged in spaced and parallel relationship, in parallel with the axes of the rolls, imparting rotation to the workpiece from drives through either the rolls or flanges disposed at both ends of the workpiece, at the same time forcing mandrels, slidably fitted at ends in the central openings of the flanges, through the openings into the workpiece, longitudinally from the both ends thereof, toward each other, and removing the excess metal left in the midportion of the workpiece between the mandrels by slightly moving the rolls toward each other for added compression, thereby producing spaces between the mandrels and the workpiece, and by moving the mandrels axially together with the excess metal to separate the latter from the rest of the workpiece.

1 Claim, 18 Drawing Figures

METHOD OF FORMING HOLLOW PARTS

This invention relates to a method of roll forming hollow shapes or parts having an axial through hole, such as stepped hollow shafts.

Usually, for large- or medium-scale production of stepped hollow shafts each formed with an axial through hole, die forging or casting is used. However, casting has limited application because much reliance cannot be placed on the material strength of the products. Forging poses problems, including flash development along the parting faces.

In die forging stepped hollow shafts, especially those having large-diameter flanges at both ends, parting faces are difficult to secure. Therefore, the forged pieces have to go through a number of process steps for partial working or machining to desired shape and size of the products. Alternatively, the shaft material is first die forged as divided midway into two pieces, each having one end flange, and the split portions are machined for edge preparation, abutted against each other, and molded or otherwise joined together. Resulting burrs are removed by machining, and the product having desired shape and size is obtained. These and other similar techniques require far more process steps and greater numbers of man-hours than ordinary die forging.

The present invention is aimed at providing a method of forming hollow parts, which overcomes the aforedescribed difficulties of the conventional die forging and produces with ease stepped hollow shafts free from flash and having a hole of desired diameter along the central axis.

The method of the invention replaces the die forging heretofore in use whereby dies contoured to give a desired shape to parts are caused to move back and forth and a round bar or preformed workpiece is pressed between the dies to get the desired shape and size. Instead, according to the invention, a stepped hollow shaft, or in other words, a hollow part having a plurality of circumferential surfaces of differing radii is obtained by steps of introducing a round bar into a space between a plurality of freely rotatable or rotatingly driven rolls, in parallel with the roll axes, said rolls or forming rolls having a plurality of circumferential forming surfaces of differing radii said rolls being arranged in preselected positions with their axes in parallel; axially positioning and constrating the both ends of the workpiece with a pair of freely rotatable or rotatingly driven flanges; forcing mandrels, coaxial with the workpiece, through the central openings of the flanges in the constraining positions into the workpiece from the both ends toward each other, thus piercing the interior while expanding the exterior material diametrically; and forming as desired the expanded exterior of the workpiece with the freely rotatable or rotatingly driven rolls in rolling contact with the workpiece, while reducing the piercing force requirements of the mandrels by the Mannesmann effect that results from the rotational forming of the exterior, the forming of the exterior, interior, and end faces of the product being controlled to the desired configurations and dimensions by the roll surfaces, inner side faces of the flanges, and outer surfaces of the mandrels in the foregoing series of piercing and rotational forming steps. Further, the method of the invention comprises an additional step of producing a through hole of a desired diameter in the workpiece by axially inching the pair of mandrels together in either rightward or leftward direction, in the same spaced relation as in the last-mentioned step, i.e., while rotating the workpiece already formed with blind holes from both ends by the compressing mandrels, shearing off the excess metal left unremoved in the midportion of the workpiece with the aid of tensile stresses that results circumferentially from the rotational forming, and then forcing (moving) the following mandrel farther into the workpiece up to a point short of the other end of the workpiece.

The above and other object, features, and advantages of the invention will become more apparent from the following detailed description taken in connection with the accompanying drawings, wherein:

FIGS. 5 through 12 are views explanatory of a sequence of steps for forming a stepped hollow shaft in accordance with the invention, in which FIG. 6 is a side view of the arrangement shown in FIG. 5, FIG. 8 is a side view of the arrangement in FIG. 7, FIG. 10 is a sectional view taken along the line B-B of FIG. 9, and FIG. 12 is a sectional view taken along the line C-C of FIG. 11;

Figure 1:
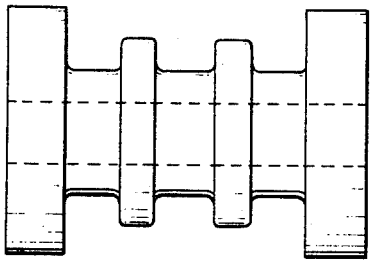
FIG. 1 is a front view of a stepped hollow shaft formed by the method of the invention.
Figure 2:
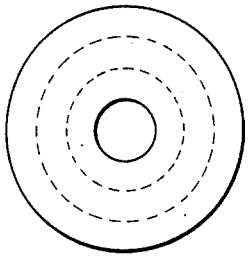
FIG. 2 is an end view of the shaft so made.
Figure 3:
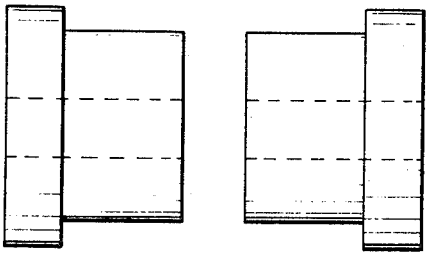
FIG. 3 PRIOR ART
FIGS. 3 and 4 are schematic views illustrating a conventional sequence of steps for forming a stepped hollow shaft.
Figure 4:
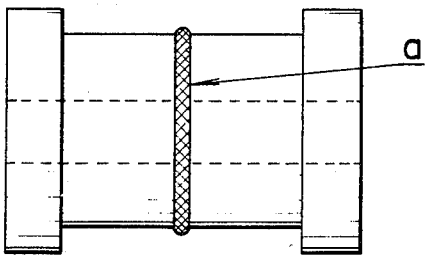
FIG. 4 PRIOR ART

Referring now to FIGS. 1 and 2, there is shown a typical stepped hollow shaft which can be manufactured with ease in accordance with the invention. Usually, a stepped hollow shaft as shown, with large-diameter flanges at both ends and a plurality of annular projections of a smaller diameter formed in between, is made in two different ways. In one method an axial hole is drilled through a workpiece and then the piece is die-forged with dies whose parting faces form planes across the axis. In the other, two workpieces to form the halves of the shaft as divided in the middle are made first, as shown in FIG. 3, each consisting of an end flange and a section smaller in diameter but larger than the annular projection to be subsequently formed. These pieces are joined with a joint a as in FIG. 4. The joined piece is then machined or otherwise worked to desired shape and size as a complete product shown in FIGS. 1 and 2.

FIGS. 5 to 12 illustrate an embodiment of the invention. Throughout these figures, numerals 1, 1' indicate forming rolls for giving a desired external shape to a workpiece, 2 indicates the workpiece, 3, 3' are flanges for axially pressing and positioning the workpiece introduced between the forming rolls 1, 1', 4, 4' are mandrels inserted through central openings of the flanges 3, 3' and which are axially slidable independently of the flanges, 5, 5' are guide plates for horizontally holding the workpiece 2 in the space between the forming rolls 1, 1', and 6 is the formed product.

Figure 5:
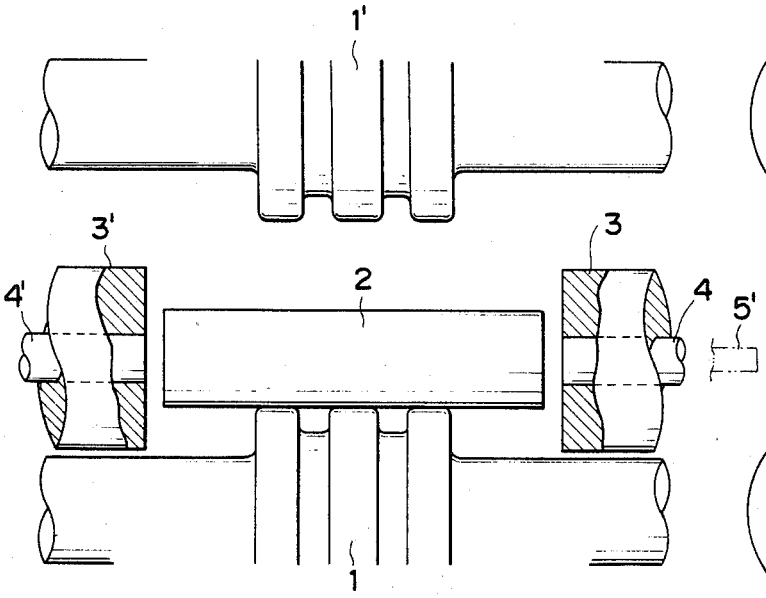
Figure 6:
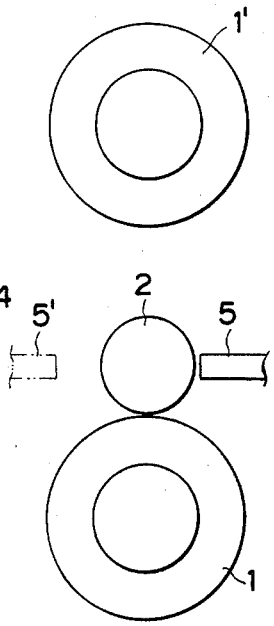

As shown in FIGS. 5 and 6, the workpiece is introduced into the space between the forming rolls 1, 1', in parallel with the roll axes, and is held by the guide plate 5 and the forming roll 1.

Figure 7:
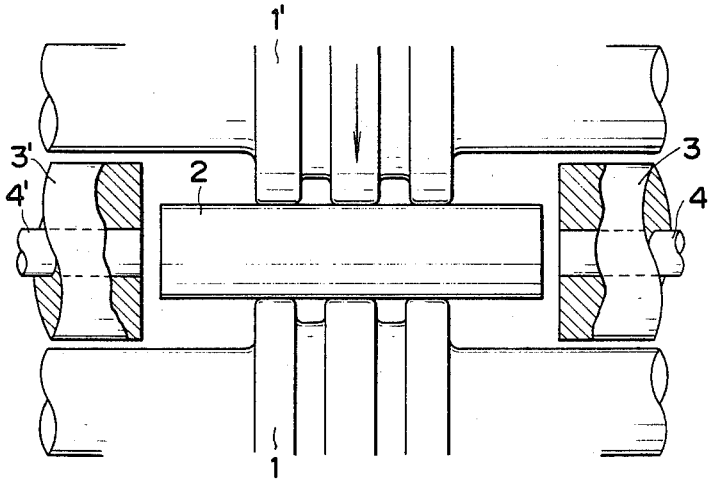
Figure 8:
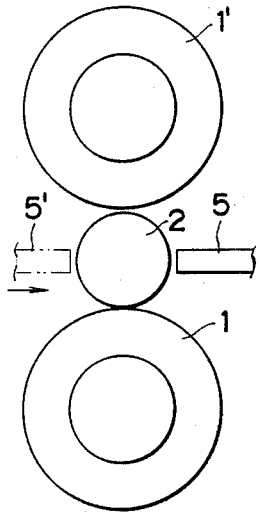

Next, as indicated in FIGS. 7 and 8, the other forming roll 1' moves into close proximity to the workpiece. Where necessary, the other guide plate 5', represented by a broken line in FIG. 8, approaches in the direction of the arrow to prevent the workpiece from rolling out from between the rolls.

Figure 9:
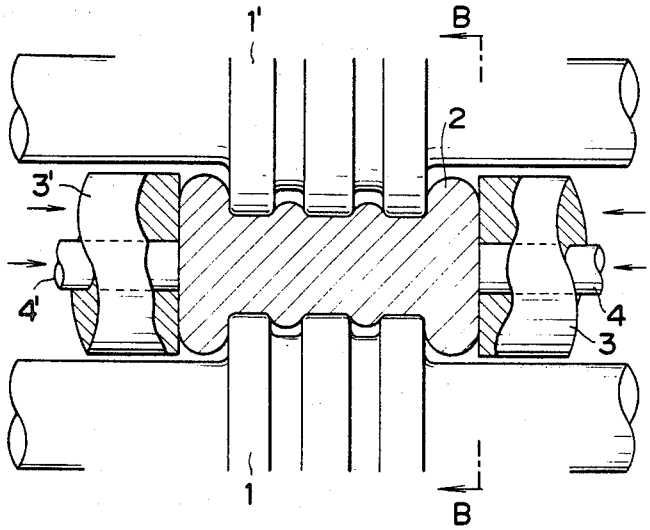
Figure 10:
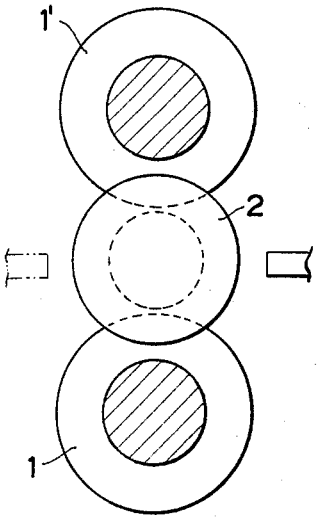

As in FIG. 9, the combined set of the flange 3 and mandrel 4 and that of the flange 3' and mandrel 4' are forced, by oil hydraulic or other suitable drives, toward the opposing ends of the workpiece 2 until they press the latter axially and stop at given points.

For uniform plastic deformation, the workpiece 2 is desirably rotated during this. The rotation may be imparted by either the forming rolls 1, 1' or flanges 3, 3'. When the forming rolls are used for this purpose, the flanges and mandrels must be set free for rotation, or, when the flanges are used, the rolls and mandrels must be freely rotatable.

The pressing step of FIG. 9 may be omitted as inessential for workpieces of certain shapes or sizes.

Figure 11:
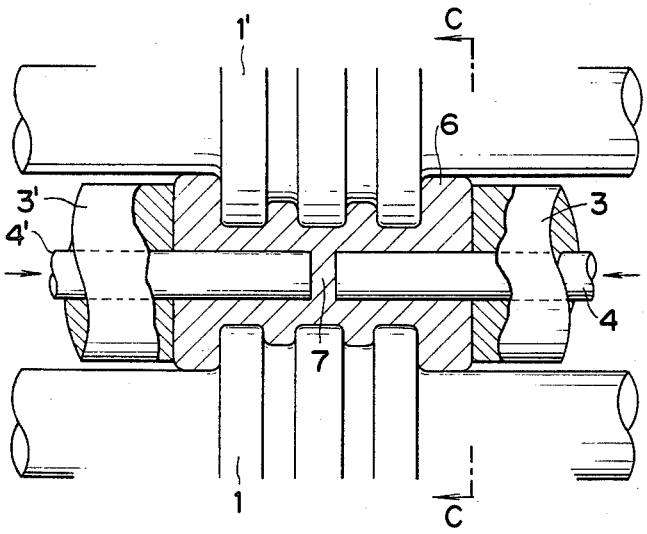
Figure 12:
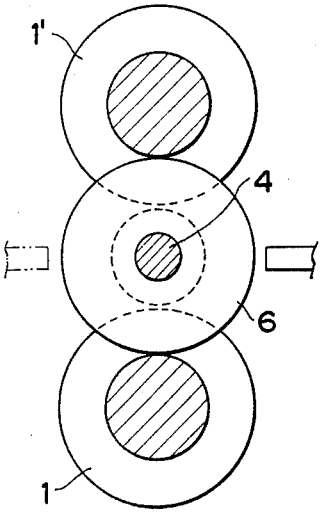

From the state shown in FIG. 9, the mandrels 4, 4' are pushed from the both ends of the workpiece inwardly toward each other, as in FIG. 11. This causes the workpiece to bulge radially, undergoing deformation in such a manner as to fill up the openings defined by the indented surface contours of the forming rolls 1, 1'. In this stage of operation, the clearance between the rolls may be either kept unchanged or slightly increased or decreased. Also, the mandrels 4, 4' are sometimes desired to have conical rather than flat ends.

The compression of the workpiece from around, while in rotation, as shown in FIG. 9 produces secondary tensile stresses to act on the interior of the workpiece, as is well known to those skilled in the art. Consequently, the forces required to push in the mandrels in the step of FIG. 11 are less than the requirements when the workpiece is not rotated.

Figure 13:
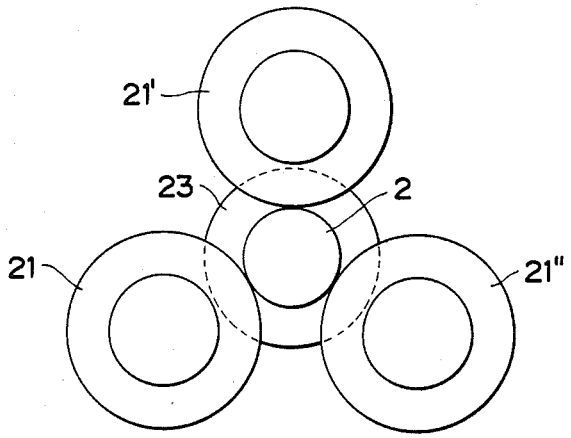
FIG. 13 is an end view of another embodiment of the invention.

FIG. 13 illustrates another embodiment of the invention, in which the above-mentioned guide plates 5, 5' are eliminated and replaced by a set of three forming rolls 21, 21', 21'', and the diameter of flanges 23 is increased to economize on the roll material.

Figure 14:
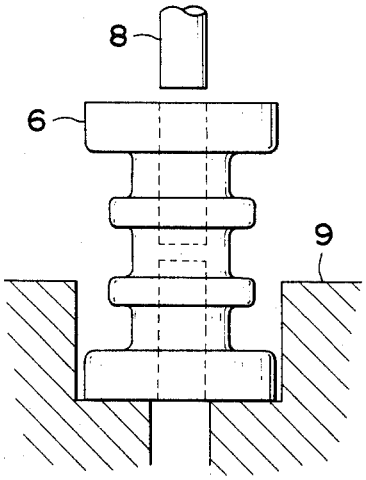
FIGS. 14 and 15 are views explanatory of a procedure for removing excess metal from the midportion of a workpiece being pierced in ordinary die forging.
Figure 15:
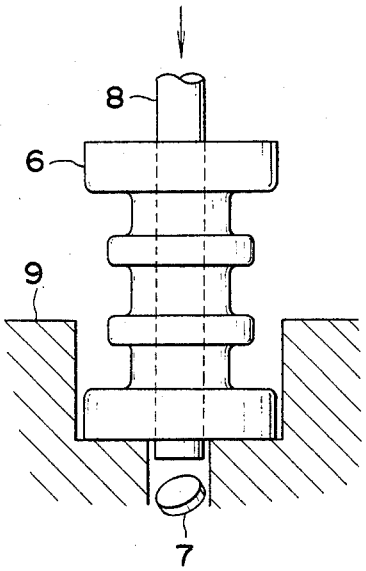

After the step illustrated in FIG. 11, a midportion 7 of the workpiece is left unbored as excess metal. In ordinary die forging, such excess metal would usually be removed, as depicted in FIGS. 14 and 15, by forcing a punch 8 from one end into the workpiece by means of a press or die not shown and causing the punch to shear off the metal.

In the usual practice, the unbored portion 7 is pushed off in sliding contact with the surrounding wall of the bore under substantial surface pressure. This puts a considerable load on the leading end of the punch 8, tending to produce strains in the product 6 held between the female die 9 and the punch 8.

Figure 16:
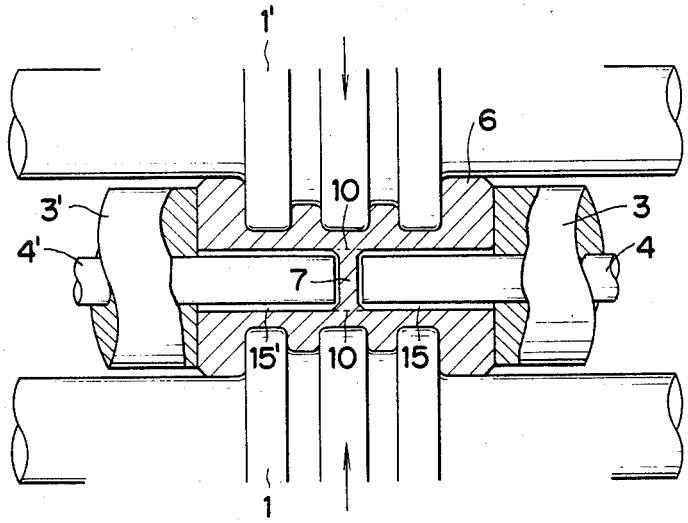
FIGS. 16 to 18 are views explanatory of a procedure for removing excess metal from the midportion of a workpiece in conformity with the invention.
Figure 17:
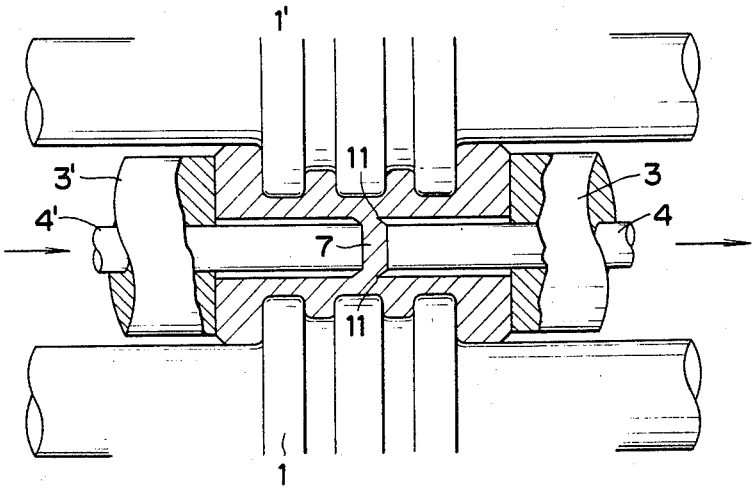

It is the second feature of the invention to form a through hole by utilizing the forming rolls and mandrels shown in FIGS. 5 to 12 so as to settle the foregoing problem and decrease the number of process steps, as embodied in FIGS. 16 and 17.

Following the forming steps illustrated in FIGS. 5 to 12, the forming rolls 1, 1' are moved slightly toward each other for additional compression, while the workpiece 6 is being rotated. This rolling action causes radial expansion of the workpiece, with the result that spaces 15, 15' are formed between the mandrels 4, 4' and the blind holes already formed in the stock, as typically represented in FIG. 16. At this time, the unbored portion 7 is quite easy to fracture under tensile stresses exerted radially from an annular boundary indicated by broken lines.

In this state, as shown in FIG. 17, the mandrels 4, 4' are inched together in the direction indicated by arrows, with the excess metal of unbored portion 7 held in between. A shearing crack 11 will readily begin to develop along the annular boundary 10.

Figure 18:
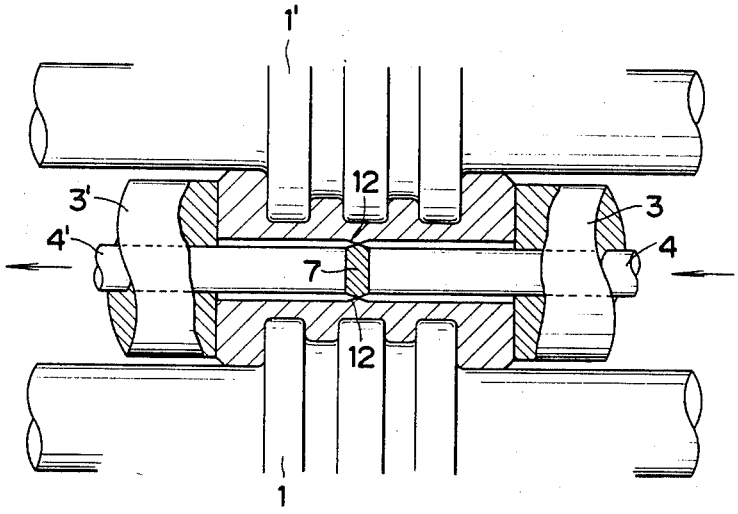

When the shearing crack 11 has grown to about the midpoint of the boundary 10, the mandrels 4, 4' are moved in the reverse direction, as indicated in FIG. 18. This produces another shearing crack 12 contrariwise until the two cracks 11, 12 are joined. The excess metal 7 is then removed and a very satisfactory sheared surface can be obtained with a minimum of shear droop.

The step illustrated in FIG. 18 is not always essential. As in ordinary blanking work, the unidirectional mandrel movement shown in FIG. 17 may be kept on so that, by the action of tensile stresses upon the boundary 10, a sheared surface with practically adequate accuracy can be produced.

The forming method according to the invention is characterized by the foregoing constructions of forming rolls and mandrels with flanges and also by the process of forming. It presents the following advantages:

(1) Since the exterior of the workpiece is formed by rolls, there is no possibility of developing flash as in die forging, and a product of greater accuracy is obtained.

(2) Piercing, usually done by a separate step, is carried out simultaneously with the external forming. Thus, hollow articles flanged at both ends and difficult to make by conventional die forging can be obtained in simple operation.

(3) The wear of die and punch, a drawback of closed forging, is overcome in accordance with the invention. Because rolls are used as outer dies and mandrels are forced into the workpiece easy to pierce while being rotationally formed on the exterior by the rolls, the mandrel life is substantially extended. Moreover, because the rolls run in line contact with the workpiece, the die life is long. For these reasons the wear of the tools can be greatly lessened.

As has been described above, the method of forming hollow parts according to the invention is a great contribution to the sector of industry for material working for the fabrication of hollow shapes.

What is claimed is:

1. A method of forming hollow parts having a plurality of circumferential surfaces of differing radii which comprise the steps of:

introducing a workpiece into the space between a plurality of forming rolls rotatably arranged and spaced in parallel relationship, the axis of said workpiece being in parallel with the axes of said forming rolls, said forming rolls being provided with a plurality of circumferential forming surfaces having differing radii;

providing flanges disposed at each end of the workpiece;

imparting rotation to said workpiece;

forming the circumferential surface of said hollow part by the application of force between said forming rolls and the workpiece and controlling the flow of material of the workpiece by said flanges;

forcing mandrels, during the rotation, slidably fitted at the end of the workpiece in central openings of said flanges, through said openings into said workpiece, longitudinally from both ends thereof, towards each other; and removing excess metal left in the midportion of the workpiece between the mandrels by slightly moving said forming rolls toward each other for added compression, thereby producing spaces between said mandrels and said workpiece, and by moving said mandrels axially together with said excess metal to separate the excess metal from the remainder of the workpiece forming a through hole of desired diameter.

* * * * *